US008800770B2

(12) United States Patent
Percival et al.

(10) Patent No.: US 8,800,770 B2
(45) Date of Patent: Aug. 12, 2014

(54) PACKAGING FOR CONSTRAINING A UNIT OF ARTICLES

(75) Inventors: Stuart Percival, Knutsford (GB); Charles Brooke, Hale (GB)

(73) Assignee: Kellogg Company, Battle Creek, MI (US)

( * ) Notice: Subject to any disclaimer, the term of this patent is extended or adjusted under 35 U.S.C. 154(b) by 139 days.

(21) Appl. No.: 13/303,205

(22) Filed: Nov. 23, 2011

(65) Prior Publication Data

US 2012/0125983 A1 May 24, 2012

Related U.S. Application Data

(60) Provisional application No. 61/416,978, filed on Nov. 24, 2010, provisional application No. 61/534,454, filed on Sep. 14, 2011.

(51) Int. Cl.
*B65D 65/00* (2006.01)

(52) U.S. Cl.
USPC ..... 206/497; 206/770

(58) Field of Classification Search
CPC ..... B65D 75/0041
USPC ..... 206/497, 770, 774, 769; 229/87.05
See application file for complete search history.

(56) References Cited

U.S. PATENT DOCUMENTS

| | | | | |
|---|---|---|---|---|
| 3,227,359 | A | 1/1966 | Hanlon | |
| 3,261,538 | A * | 7/1966 | Jones et al. | 206/459.5 |
| 3,338,404 | A | 8/1967 | Becker et al. | |
| 3,388,788 | A * | 6/1968 | Hellem | 206/497 |
| 3,826,357 | A * | 7/1974 | Roth | 206/497 |

FOREIGN PATENT DOCUMENTS

| | | |
|---|---|---|
| FR | 2087292 | 12/1971 |
| FR | 2199319 | 4/1974 |

OTHER PUBLICATIONS

International Search Report, 6 pages dated Mar. 21, 2012.

* cited by examiner

*Primary Examiner* — David Fidei
(74) *Attorney, Agent, or Firm* — Honigman Miller Schwartz and Cohn; Kathryn D. Soulier; Jonathan P. O'Brien

(57) ABSTRACT

A packaging system, for opening and unloading a plurality of articles onto a display, includes a plurality of articles arranged to define a unit. The unit includes a front side, a back side, a pair of lateral sides extending between the front and back sides, a bottom, and a top. The unit may include a tray. A tubular film that extends between first and second ends, encircles the unit to secure the plurality of articles defining the unit. A series of first perforations are defined in the film and arranged in two bottom lines that are spaced from each other and extend along the bottom of the unit from the first end to the second end of the film. The bottom lines are spaced on the bottom to define the film into a lower portion that extends between the two bottom lines and a remaining portion.

19 Claims, 4 Drawing Sheets

PACKAGING FOR CONSTRAINING A UNIT OF ARTICLES

CROSS REFERENCE TO RELATED APPLICATION

This application claims the benefit of U.S. Provisional Patent Application Ser. No. 61/416,978 for PACKAGING FOR CONSTRAINING A UNIT OF ARTICLES, filed on Nov. 24, 2010, and U.S. Provisional Patent Application Ser. No. 61/534,454 for PACKAGING FOR CONSTRAINING A UNIT OF ARTICLES, filed on Sep. 14, 2011, which are hereby incorporated by reference in their entirety.

BACKGROUND OF THE INVENTION

1. Field of the Invention

The invention relates generally to an easy opening packaging system for the unloading of a plurality of articles, collated to form a unit, onto a display and a method for unloading the plurality of articles onto the display.

2. Description of the Prior Art

It is well known in the prior art to constrain a unit of articles with a film. For example, U.S. Patent Publication 2010/0224530 to Singh et al. discloses a packaging for a unit having a front side, a back side opposite the front side, and a bottom side extending between the front side and the back side. The packaging includes a film that encircles the unit.

Another such patent is U.S. Pat. No. 5,067,612 to Tsuchiya et al. The Tsuchiya patent discloses a packaging system having a tape shaped overlapping portion formed on a film. The tape-shaped overlapping portion is partially welded to the film and includes perforated lines. The perforations allow for the tearing of the tape-shaped overlapping portion along the perforations to open the package and allow the articles to be taken out. The Tsuchiya patent further discloses that the tape-shaped overlapping portion may extend from the front to the back along the top.

Another such patent is U.S. Pat. No. 5,201,463 to George. The George Patent discloses a packaging system for a plurality of packages that are vulnerable to damage when cut into by a sharp instrument. A rectangular container encloses all of the packages. A shrink wrap material is applied to the container and shrunk into engagement therewith to enclose the container. The shrink wrap includes a slot portion that is disposed in the top and extends from one side of the lid to the other. Two paired series of weakened lines are formed in the shrink wrap and extend away from the slot to opposing sides. To open the package, a user may grasp the wrap at the slot and pull towards one of the opposing sides to tear the package along one of the pairs of weakened lines.

SUMMARY OF THE INVENTION

In view of the above, the packaging system of the present invention provides for the easy opening and unloading of a plurality of articles, collated to form a unit, onto a display. The plurality of articles are arranged in at least one row to define the unit. The unit includes a front side, a back side opposite the front side, a pair of lateral sides opposite each other and extending between the front and back sides, a bottom extending between the front and back sides, and a top opposite the bottom. A tubular film extends between first and second ends and encircles the unit to secure the plurality of articles that define the unit by tension. A series of first perforations are defined in the film and arranged in two bottom lines that are spaced from each other and extend along the bottom of the unit from the first end to the second end of the film. Each of the bottom lines are disposed adjacent a different one of the lateral sides to define the film into a lower portion that extends between the two bottom lines and along the bottom of the unit and a remaining portion.

During the loading of the unit onto the display, the unit is placed over the display with the back side of the unit being disposed adjacent a distal end of the display. The lower portion of the unit is torn from the remaining portion along the bottom lines of first perforations from adjacent the back side and towards the front side. Simultaneously, the front side of the unit is pushed or directed downwardly and towards the proximal end of the display to remove the lower portion of the film, while maintaining the articles in the unit. After the lower portion has been removed, the remaining portion of the film is removed from the unit. Simultaneously, the front side of the unit is directed or pushed towards the proximal end of the display, until the front side of the unit is aligned with a distal end of the display.

Advantages of the Invention

The present invention achieves advantages, by providing a packaging for a unit of articles that are loaded onto a shelf with the packaging removed in a matter of seconds. The invention includes a series of first perforations in the film that are arranged in two bottom lines that extend from the back side to the front side and along the bottom side of the unit. The invention also includes the simultaneously tearing the bottom portion of the film from the remaining portion along the bottom lines of first perforations from adjacent the back side and towards the front side and pushing on the front side of the unit to swiftly remove the lower portion of the film while maintaining the articles in the unit.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
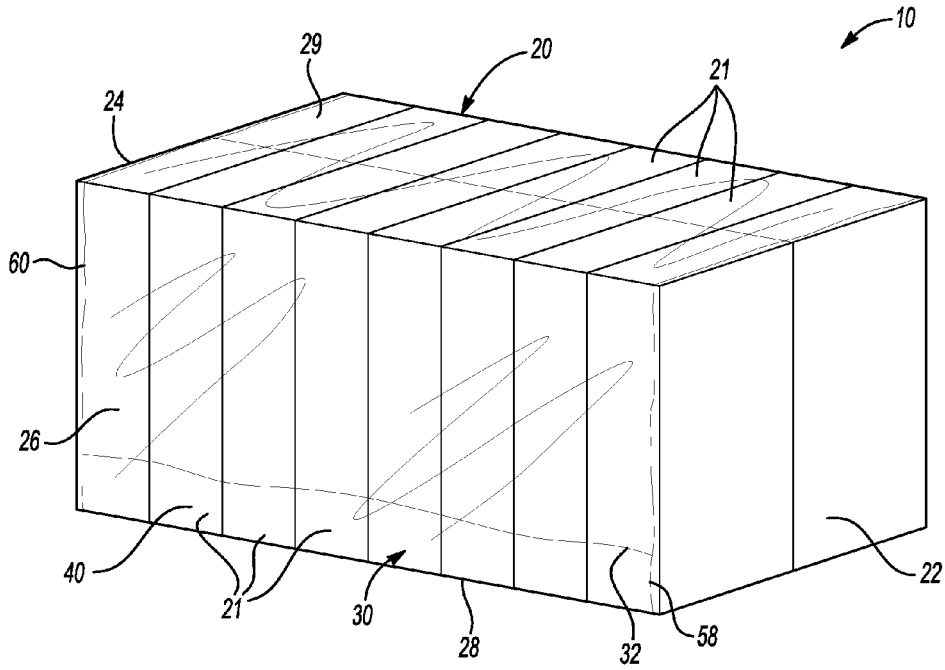
FIG. 1 is a perspective view of a packaging system according to the subject invention.

Referring to the Figures, wherein like numerals indicate corresponding parts throughout the several views, an easy opening packaging system 10 for the unloading of a plurality of articles 21, collated to form a unit 20, onto a display 44 is generally shown. For exemplary purposes, the display 44 extends from a proximal end 46 to a distal end 48 to receive the plurality of articles 21 from the unit 20. In the exemplary embodiment, the display 44 is a shelf, and more specifically a shelf that would be found in a grocery store, but the display 44 may be any type display 44 known in the art, at any known location having displays 44.

The packaging system 10 of the subject invention includes a plurality of articles 21 that are arranged in at least one row to define a unit 20. The plurality of articles 21 are a plurality of products boxed for shipment and subsequent display 44. For example, the plurality of articles 21 could be a snack product, cereal product, or any other boxed product known in the art. The plurality of articles 21 maybe arranged in a plurality of rows. For example, the exemplary embodiment, as shown in FIG. 1, shows the plurality of articles 21 being disposed in two rows. The unit 20 formed has a front side 22, a back side 24 opposite the front side 22, a pair of lateral sides 26 opposite each other and extending between the front and back sides 22, 24, a bottom 28 extending between the front and back sides 22, 24, and a top 29 opposite the bottom 28.

Figure 6:
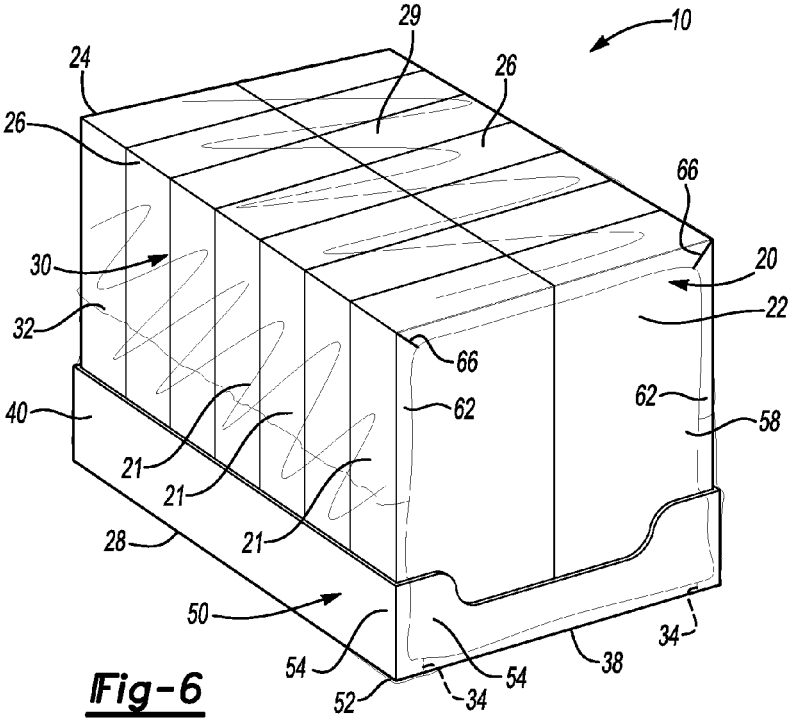
FIG. 6 is a perspective view of a packaging system having a tray for supporting the plurality of articles forming the unit according to the subject invention.

As seen in FIG. 6, the packaging system 10 of the subject invention may include a tray 50 to receive and support the plurality of articles 21 and further which defines the unit 20. The tray 50 includes a base portion 52 and at least one wall portion 54 that extends upwardly from the base portion 52. In the exemplary embodiment, the base portion 52 is shaped to correspond to the shape of the bottom 28 of the unit 20. The at least one wall portion 54 extends upwardly to at least partially cover at least one of the sides 22, 24, 26 of the unit 20. In the exemplary embodiment, and as seen in FIG. 6, the at least one wall portion 54 extends up only a portion of the side 22, 24, 26 in which it extends. While in the exemplary embodiment, the at least one wall portion 54 may only extend up a portion of the corresponding side 22, 24, 26, it could extend any distance up the side 22, 24, 26, including up the entire side in which it is disposed on.

The tray 50 may include a plurality of wall portions 54 that extend upwardly from the base portion 52. Each one of the plurality of wall portions 54 extend up a corresponding side to at least partially cover that side 22, 24, 26 of the unit 20.

The tray 50 may include a pair of wall portions 54 that extend upwardly from the base portion 52, with each of the wall portions 54 at least partially covering the oppositely disposed lateral sides 26 of the unit 20. In such a system, the pair of wall portions 54 are spaced to define at least one open end 56. The open end 56 allows for the removal of the plurality of articles 21 from the tray 50. Each of the wall portions 54 at least partially cover the oppositely disposed lateral sides 26 of the unit 20, while the at least one open end 56 is disposed across one of the front and back sides 22, 24 of the unit 20, preferably the back side 24 to allow the plurality of articles 21 to slide out of the tray 50 during the unloading process.

The tray 50 may include three wall portions 54 that extend upwardly from the base portion 52, with each one of the wall portions 54 at least partially covering one of the sides 22, 24, 26 of the unit 20. In such a system, the three wall portions 54 include the pair of wall portions 54 that at least partially cover the oppositely disposed lateral sides 26 of the unit 20 and are spaced to define the open end 56. In the preferred embodiment, the open end 56 is disposed adjacent the back side 24 of the unit 20 to allow the plurality of articles 21 to be slid out the back side 24 of the unit 20 and onto the display 44.

A tubular film 30, which extends between first and second ends 58, 60, encircles the unit 20 to secure the plurality of articles 21 that define the unit 20. The tubular film 30, uses tension to secure the plurality of articles 21 forming the unit 20. The film 30 may be a stretch wrap or heat shrinkable film 30 that is disposed about the plurality of articles 21. In the exemplary embodiment, a pair of heat seams 32, which are disposed opposite of each other and each along a different one of the lateral sides 26, extend between the first and second ends 58, 60. While the exemplary embodiment teaches a pair of heat seams 32, any number of heat seams 32 may be included. In an alternative embodiment, no heat seams 32 are needed and the film 30 may flow continuously about the unit 20.

The film 30 engages each of the top 29, the bottom 28, and the lateral sides 26 of the unit 20. The film 30 extends between the front and back sides 22, 24 with the first end 58 of the film 30 being disposed adjacent the front side 22 and the second end 60 of the film 30 being disposed adjacent the back side 24.

The tubular film 30 includes a series of first perforations 34 that are defined in the film 30 and arranged in two bottom lines 36. The two bottom lines 36 are spaced from each other and extend along the bottom 28 of the unit 20 from the first end 58 to the second end 60 of the film 30. In the exemplary embodiment, each of the bottom lines 36 are adjacent a different one of the lateral sides 26 to define the film 30 into a lower portion 38 and a remaining portion 40. The lower portion 38 includes the film 30 that is disposed between the two bottom lines 36 and along the bottom 28 of the unit 20. The remaining portion 40 covers the remainder of the unit 20 including the portion of the film 30 disposed along the lateral sides 26 and top 29.

The present invention may further include at least one pair of bottom notches 42. Each of the bottom notches 42 are disposed adjacent one of the first and second ends 58, 60 of the film 30, with each of the bottom lines 36 extending between the pair of bottom notches 42. The bottom notches 42 facilitate the tearing of the film 30 along each of the bottom lines 36.

The tubular film 30 may further include a series of second perforations 68 that are defined in the film 30 and arranged in two top lines 70. The top lines 70 are spaced from each other and extend along the top 29 of the unit 20 from the first end 58 to the second end 60 of the film 30. In the exemplary embodiment, each of the top lines 70 are adjacent a different one of the lateral sides 26 to further define the remaining portion 40 of the film 30 into a top portion 72 and a pair of side portions 74. The top portion 72 is the film 30 disposed between the two top lines 70 and along the top 29 of the unit 20. Each of the pair of side portions 74 extend between one of the top lines 70 and one of the bottom lines 36 and over one of the lateral sides 26.

Figure 2:
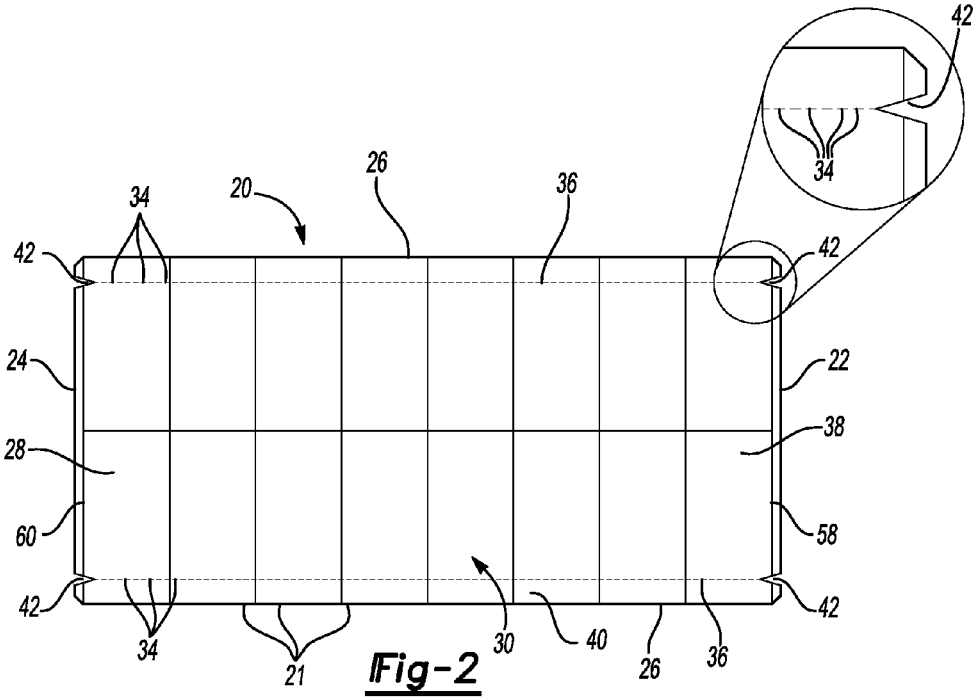
FIG. 2 is a bottom view of the packaging system according to the subject invention.
Figure 3:
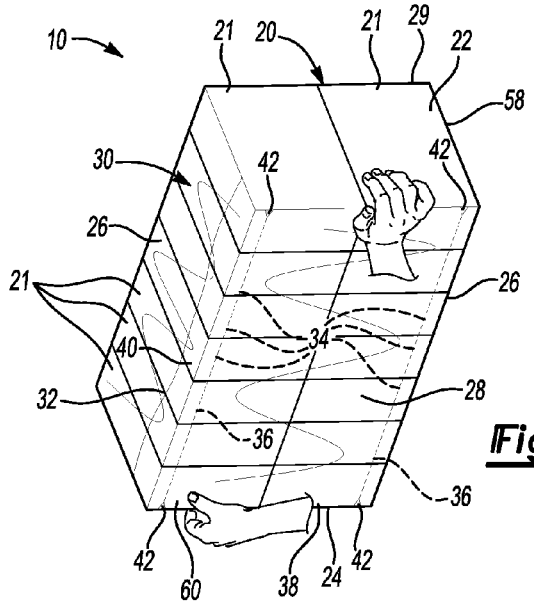
FIG. 3 is a perspective view of supporting a unit within the packaging system according to the subject invention.
Figure 4:
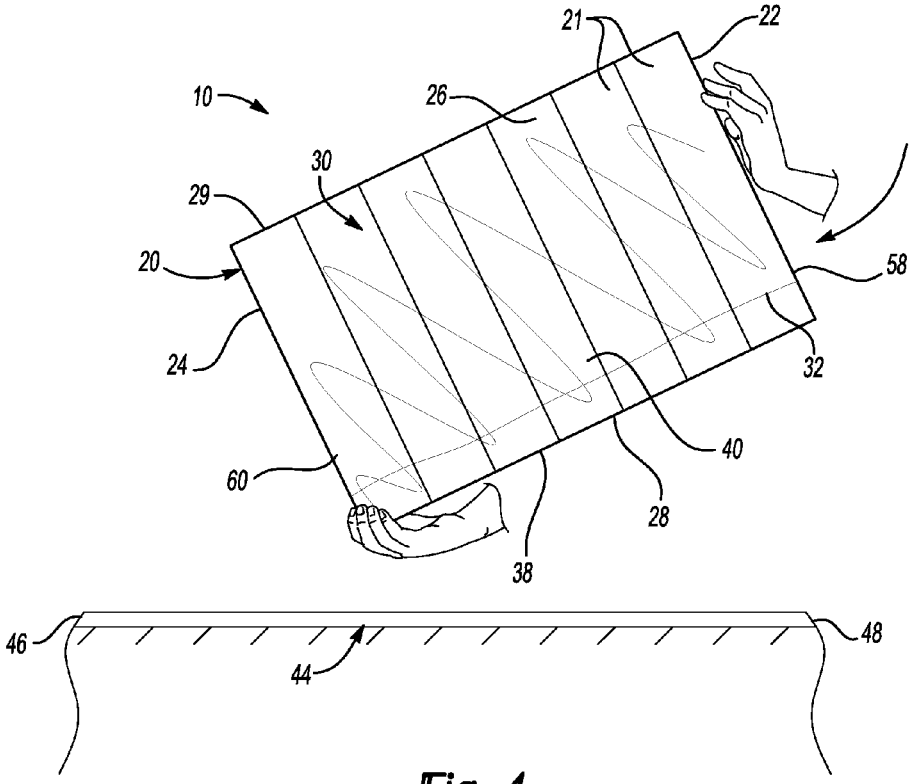
FIG. 4 is a side view showing the step of removing a lower portion of the film of the packaging system according to the subject invention.
Figure 5:
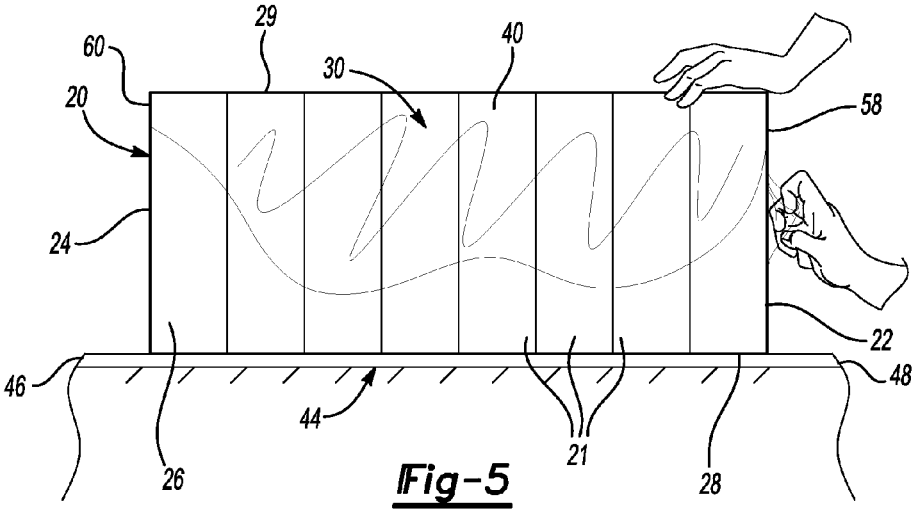
FIG. 5 is a side view showing the step of removing a remaining portion of the film of the packaging system according to the subject invention.

The present invention may further include at least one pair of top notches. The top notches are equivalent to and provide the same function as the bottom notches 42 shown in FIG. 2. Each of the top notches are disposed adjacent one of the first and second ends 58, 60 of the film 30, with each of the top lines 70 extending between the pair of top notches. The top notches facilitate the tearing of the film 30 along each of the top lines 70.

The film 30 extends between the front and back sides 22, 24 with the first end 58 of the film 30 being disposed adjacent the front side 22 and the second end 60 of the film 30 being disposed adjacent the back side 24. The first end 58 of the film 30 may be disposed at or inwardly of the front side 22 along each of the top 29, the bottom 28 and the lateral sides 26. In addition, the second end 60 of the film 30 may be disposed at or inwardly of the back side 24 along each of the top 29, the bottom 28 and the lateral sides 26. Such a system is best shown in FIG. 1.

Figure 7:
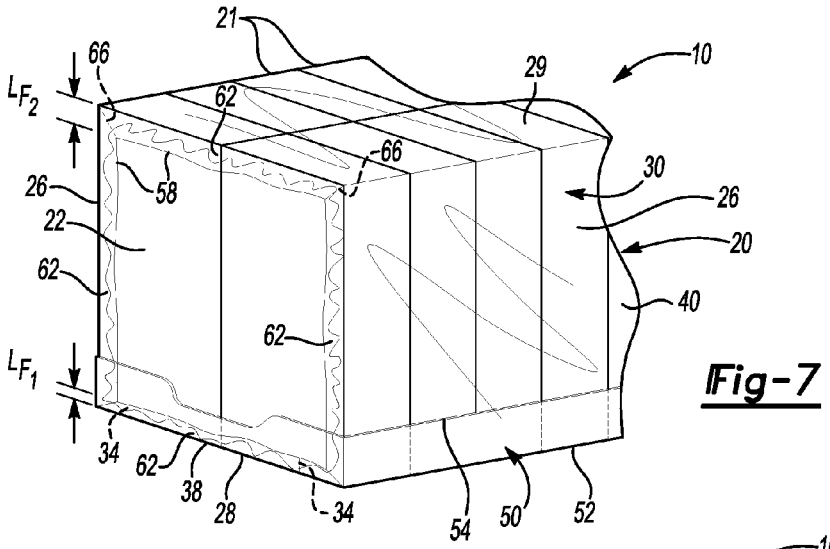
FIG. 7 is a partial perspective front view of a packaging system having tabbed portions disposed in the corners of the front side adjacent the top according to the subject invention.
Figure 9:
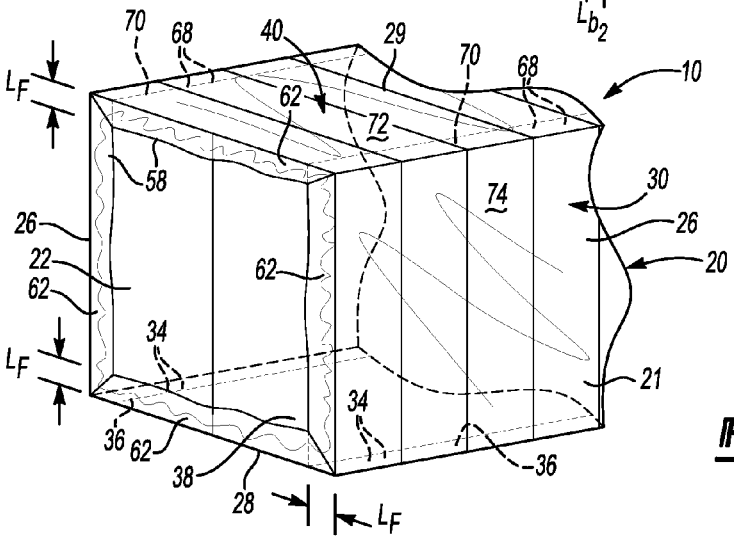
FIG. 9 is a partial perspective front view of an exemplary packaging system having a series of second perforation that define a pair of top lines in the top of the packaging system according to the subject invention.

The first end 58 of the film 30 may extend outwardly from each of the top 29, the bottom 28 and the lateral sides 26 and onto the front side 22 of the unit 20 to define a front edge portion 62. As seen in FIGS. 7 and 9, the front edge portion 62 partially covers the front side 22 of the unit 20 a front edge length $L_f$ to further secure the unit 20. The front edge length $L_f$ that the front edge portion 62 extends onto the front side 22 of the unit 20 from each of the top 29, the bottom 28 and the lateral sides 26 can be equal or it may be varied. For example, as seen in FIG. 9, the front edge portion 62 has a front edge length $L_{f1}$ that is an equal distance from each of the edges of the front side 22 of the unit 20. As seen in FIG. 7, the front edge length $L_{f1}$ of the portion of the front edge portion 62 that extends inwardly from the edge of the front side 22 adjacent the bottom 28 is less than the front edge length $L_{f2}$ of the remaining portions extending inwardly from each of the remaining edges of the front side 22 of the unit 20. This allows for better separation of the lower portion 38 of the film 30 from the remaining portion 40 of the film 30.

The front edge portion 62 may be disposed loosely on the front side 22 of the unit 20 to ensure constant tension to the front side 22 and to allow the plurality of articles 21 to move within the film 30 without becoming loose. In addition, the front edge portion 62 may be disposed tightly on the front side 22 of the unit 20 to ensure constant tension to the front side 22.

The front edge portion 62 may include a tabbed portion 66 adjacent each of the corners of the front side 22 adjacent the top 29 and under low stress. These tabbed portions 66 allow the front edge portion 62 to be pulled apart at each of the corners adjacent the top 29 when the plurality of articles 21 are loaded onto the display 44.

Figure 8:
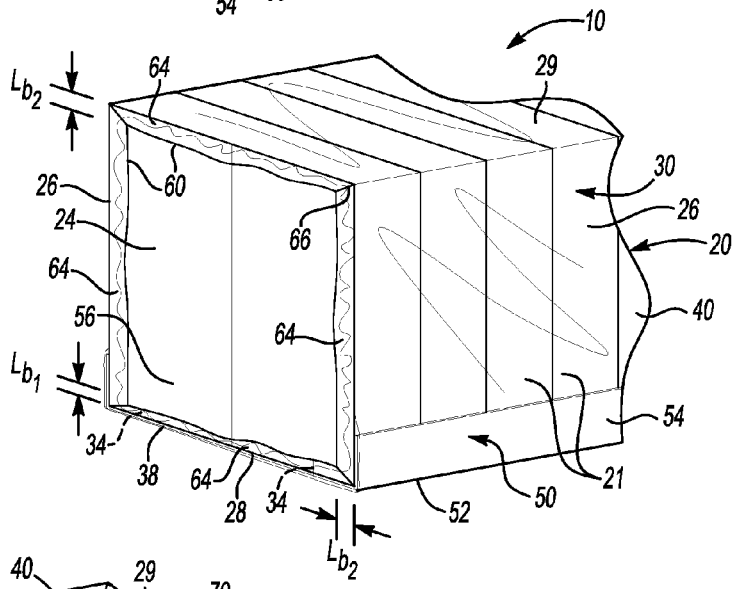
FIG. 8 is a partial perspective back view of a packaging system having a back edge length adjacent the bottom edge that is less than the back edge lengths adjacent the remaining edges of the back face and a tray having an open end according to the subject invention.

The second end 60 of the film 30 may extend outwardly from each of the top 29, the bottom 28 and the lateral sides 26 and onto the back side 24 of the unit 20 to define a back edge portion 64. The back edge portion 64, like the front edge portion 62, partially covers the back side 24 of the unit 20 a back edge length $L_b$ to further secure the unit 20. The back edge length $L_b$ that the back edge portion 64 extends onto the back side 24 of the unit 20 from each of the top 29, the bottom 28 and the lateral sides 26 can be equal or it may be varied. For example, the back edge portion 64 has a back edge length $L_{b1}$ that is an equal distance from each of the edges of the back side 24 of the unit 20. As seen in FIG. 8, the back edge length $L_{b1}$ of the portion of the back edge portion 64 that extends inwardly from the edge of the back side 24 adjacent the bottom 28 is less than the back edge length $L_{b2}$ of the remaining portions extending inwardly from each of the remaining edges of the back side 24 of the unit 20. This allows for better separation of the lower portion 38 of the film 30 from the remaining portion 40 of the film 30.

The back edge portion 64 may be disposed loosely on the back side 24 of the unit 20 to ensure constant tension to the back side 24 and to allow the plurality of articles 21 to move within the film 30 without becoming loose. In addition, the back edge portion 64 may be disposed tightly on the back side 24 of the unit 20 to ensure constant tension to the back side 24.

The back edge portion 64, like the front edge portion 62, may include tabbed portion 66 adjacent each of the corners of the back side 24 adjacent the top 29 and under low stress. These tabbed portions 66 allow the back edge portion 64 to be pulled apart at each of the corners adjacent the top 29 when the plurality of articles 21 are loaded onto the display 44.

The placement of the first and second ends 58, 60 of the film 30 with respect to the front and back sides 22, 24 can be any of the configurations disclosed above. The front and back sides 22, 24 may have the same configuration or the configuration may vary between the front and back sides 22, 24. For example, both the front and back sides 22, 24 may include front and back edge portions 62, 64 the extend equal lengths from the respective edges of the front and back sides 22, 24. In an alternative, the front side 22 may include a front edge portion 62 having equal front edge lengths $L_f$ while the back side 24 may include a back edge portion 64 having varying back edge lengths $L_b$. Also, either both or only one of the front and back edge portions 62, 64 may be tabbed.

The subject invention further provides for a method of loading the plurality of articles 21 onto the display 44, such as a shelf, extending between a proximal end 46 and a distal end 48. In operation, the unit 20 is supported (for example, with a left hand of a person) at the bottom 28 of the unit 20 adjacent the back side 24 and also is supported at the front side 22 (for example, with a right hand of the person). The unit 20 is moved over the display 44 with the back side 24 facing the proximal end 46 of the display 44. The lower portion 38 of the film 30 is torn (for example, with the left hand of the person) from the remaining portion 40 along the bottom lines 36 from adjacent the back side 24 and towards the front side 22. Simultaneously, the front side 22 of the unit 20 is directed or pushed (for example, with the right hand of the person) downward and toward the proximal end 46 of the display 44 to swiftly remove the lower portion 38 of the film 30 while maintaining the articles 21 in the unit 20. The remaining portion 40 of the film 30 is then removed. Simultaneously, the front side 22 of the unit 20 is directed or pushed toward the proximal end 46 of the display 44 until the front side 22 of the unit 20 is aligned with the distal end 48 of the display 44.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. An easy opening packaging system for the unloading of a plurality of articles, collated to form a unit, onto a display comprising:

a plurality of articles arranged in at least one row to define a unit, said unit having a front side, a back side opposite said front side, a pair of lateral sides opposite each other and extending between said front and back sides, a bottom extending between said front and back sides, and a top opposite said bottom;

a tubular film extending between first and second ends and encircling said unit for securing said plurality of articles defining said unit by tension; and a series of first perforations defined in said film and arranged in two bottom lines being spaced from each other and extending along said bottom of said unit from said first end to said second end of said film, each of said bottom lines being disposed adjacent a different one of said lateral sides to define said film into a lower portion between said two bottom lines and along said bottom of said unit and a remaining portion;

wherein said film engages each of said top, said bottom, and said lateral sides of said unit and extends between said front and back sides with said first end of said film being disposed adjacent said front side and said second end being disposed adjacent said back side;

wherein said first end of said film extends outwardly from each of said top, said bottom and said lateral sides and onto said front side of said unit to define a front edge portion having a front edge length to partially cover said front side and further secure said unit;

wherein said front edge length of portion of said front edge portion extending inwardly from the edge of said front side adjacent said bottom is less than said front edge length of the remaining front edge portions extending inwardly from each of the remaining edges of said front side of said unit; and wherein said lower portion of the said film is torn from said remaining portion along said bottom lines of said first perforations from adjacent said back side and towards said front side as the plurality of articles are unloaded onto the display.

2. The packaging system as set forth in claim 1 further including a tray for receiving and supporting said plurality of articles and to further define said unit.

3. The packaging system as set forth in claim 2 wherein said tray includes a base portion that is shaped to correspond to the shape of said bottom of said unit and at one wall portion extending upwardly from said base portion to at least partially cover at least one of said sides of said unit.

4. The packaging system as set forth in claim 2 wherein said tray includes a pair of wall portions extending upwardly from said base portion, with each of said wall portions at least partially covering said oppositely disposed lateral sides of said unit.

5. The packaging system as set forth in claim 4 wherein said pair of wall portions are spaced to define at least one open end for the removal of said plurality of articles from said tray, said at least one open end being disposed along one of said front and back sides of said unit.

6. The packaging system as set forth in claim 5 wherein said open end is disposed along said back side of said unit.

7. The packaging system as set forth in claim 1 wherein said first end of said film is disposed inwardly of said front side and lies along each of said top, said bottom and said lateral sides.

8. The packaging system as set forth in claim 1 wherein said second end of said film is disposed inwardly of said back side and lies along each of said top, said bottom and said lateral sides.

9. The packaging system as set forth in claim 1 wherein said front edge portion is tabbed adjacent each of the corners adjacent said top of said front side under low stress for allowing said front edge portion to be pulled apart at each of the corners adjacent said top when said plurality of articles are loaded onto the display.

10. The packaging system as set forth in claim 1 wherein said second end of said film extends outwardly from each of said top, bottom and lateral sides and onto said back side of said unit to define a back edge portion having a back edge length to partially cover said back side and further secure said unit.

11. The packaging system as set forth in claim 10 wherein said back edge length of said back edge portion extending equally inwardly from each of the edges of said back side of said unit.

12. The packaging system as set forth in claim 10 wherein said back edge length of the portion of said back edge portion extending inwardly from the edge of said back side adjacent said bottom is less than said back edge length of the remaining back edge portions extending inwardly from each of the remaining edges of said back side of said unit.

13. The packaging system as set forth in claim 10 wherein said back edge portion is tabbed adjacent each of the corners adjacent said top of said back side under low stress for allowing said back edge portion to be pulled apart at each of the corners adjacent said top when said plurality of articles are loaded onto the display.

14. The packaging system as set forth in claim 1 further including a pair of bottom notches disposed is said film each of said bottom notches being disposed adjacent one of said first and second ends of said film with each of said bottom lines extending between said pair of bottom notches for facilitating the tearing of said film along said bottom lines.

15. The packaging system as set forth in claim 1 further including a series of second perforations defined in said film and arranged in two top lines being spaced from each other and extending along said top of said unit from said first end to said second end of said film.

16. The packaging system as set forth in claim 15 wherein each of said top lines are adjacent a different one of said lateral sides to further define said remaining portion of said film into a top portion disposed between said two top lines and along said top of said unit and a pair of side portions, each of said side portions extending between one of said top lines and one of said bottom lines and over one of said lateral sides.

17. The packaging system as set forth in claim 1 wherein said plurality of articles are arranged in a plurality of rows to form said unit.

18. The packaging system as set for the in claim 2 further including a series of second perforations defined in said film and arranged in two top lines being spaced from each other and extending along said top of said unit from said first end to said second end of said film.

19. The packaging system as set for the in claim 18 wherein each of said top lines are adjacent a different one of said lateral sides to further define said remaining portion of said film into a top portion between said two top lines and along said top of said unit and a pair of side portions, each of said side portions extending between one of said top lines and one of said bottom lines and over one of said lateral sides.

* * * * *